US009240643B2

(12) United States Patent
Thies et al.

(10) Patent No.: US 9,240,643 B2
(45) Date of Patent: Jan. 19, 2016

(54) DEVICE FOR CONTACTING A CIRCUIT BOARD

(71) Applicant: ROSENBERGER HOCHFREQUENZTECHNIK GMBH & CO KG, Fridolfing (DE)

(72) Inventors: Steffen Thies, Überackern (AT); Frank Tatzel, Ostermiething (AT); Manfred Rahberger, Ostermiething (AT); Roland Neuhauser, Fridolfing (DE); Tobias Oberhauser, Feichten (DE); Hauke Schütt, Bünsdorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/379,033

(22) PCT Filed: Jan. 24, 2013

(86) PCT No.: PCT/EP2013/000214
§ 371 (c)(1),
(2) Date: Aug. 15, 2014

(87) PCT Pub. No.: WO2013/120580
PCT Pub. Date: Aug. 22, 2013

(65) Prior Publication Data

US 2015/0024619 A1 Jan. 22, 2015

(30) Foreign Application Priority Data

Feb. 17, 2012 (DE) ..... 20 2012 001 645 U

(51) Int. Cl.
*H01R 12/83* (2011.01)
*H01R 12/81* (2011.01)
*H01R 4/48* (2006.01)
*H01R 13/64* (2006.01)
(Continued)

(52) U.S. Cl.
CPC ..... *H01R 12/83* (2013.01); *H01R 4/48* (2013.01); *H01R 12/81* (2013.01); *H01R 13/64* (2013.01); *H01R 11/24* (2013.01); *H01R 12/774* (2013.01); *H01R 2201/20* (2013.01)

(58) Field of Classification Search
CPC ..... H01R 11/24; H01R 12/774; H01R 12/81; H01R 13/64; H01R 4/48; H01R 12/83; H01R 2201/20
USPC ..... 439/329, 372, 370, 67, 259–260, 495, 439/499, 874, 729, 836
See application file for complete search history.

(56) References Cited

U.S. PATENT DOCUMENTS 4,700,997 A 10/1987 Strand
6,447,305 B1 9/2002 Roberts
(Continued)

FOREIGN PATENT DOCUMENTS

FR 1174063 A 3/1959

*Primary Examiner* — Edwin A. Leon
(74) *Attorney, Agent, or Firm* — DeLio, Peterson & Curcio, LLC; Robert Curcio

(57) ABSTRACT

A device for contacting a circuit board having one or more contact elements, an intake into which at least one section of the circuit board can be inserted, an actuator for moving the circuit board relative to the contact elements until the contact elements are contacted, and at least one securing component for fixing the circuit board in the position in which the contact elements are contacted.

20 Claims, 5 Drawing Sheets

(51) Int. Cl.
*H01R 11/24* (2006.01)
*H01R 12/77* (2011.01)

(56) References Cited

U.S. PATENT DOCUMENTS 6,447,317 B1 * 9/2002 Billman ..... H01R 23/72 439/108
7,341,470 B2 * 3/2008 Suzuki ..... H01R 12/778 439/260
8,740,477 B2 * 6/2014 Tamura ..... G02B 6/3817 385/139
2003/0068914 A1 4/2003 Merry et al.
2006/0279317 A1 12/2006 Takahashi
2010/0105230 A1 4/2010 Davidsson

* cited by examiner

DEVICE FOR CONTACTING A CIRCUIT BOARD

BACKGROUND OF THE INVENTION

1. Field of the Invention

The invention relates to a device for contacting a circuit board which is to be connected, at least temporarily, with, for example, a measuring device or a circuit of any kind.

2. Description of Related Art

At present it is known for such circuit boards to be contacted by plugging on one or more connector heads, which, however, is generally associated with the disadvantage of requiring a relatively large plugging force, which substantially results from the mechanical locking of the connector heads by means of spring elements. A contacting by means of connector heads is therefore unsuitable, at least in the case of circuit boards with flexible carrier plates. Moreover, connection errors can result from the plugging of the individual connector heads which can lead to damage to the circuit board or to the electrical system connected to it.

This problem is solved through a device according to, and described in, the following description of the invention and the associated claims.

SUMMARY OF THE INVENTION

Starting out from this prior art, the invention was based on the problem of describing a device which makes possible a simple, quick contacting of a circuit board and in particular avoids the application of high plugging or contact forces, so that damage to the circuit board can be avoided even if the circuit board is based on a flexible carrier plate.

This problem is solved through a device according to, and described in, the following description of the invention and the associated claims The above and other objects, which will be apparent to those skilled in the art, are achieved in the present invention which is directed to a device for contacting a circuit board comprising: at least one contact element; an intake into which at least one section of the circuit board can be inserted; a housing comprising a first housing part forming the intake and a second housing part containing the at least one of contact element, whereby the two housing parts can be moved relative to one another; an actuator for moving the intake together with the circuit board relative to the at least one contact element until the at least one contact are contacted; and at least one securing component for fixing the circuit board in the position in which the at least one contact element are contacted; whereby the two housing parts can rotate relative to one another, whereby in a first rotary position the circuit board is plugged into the intake contacts the at least one contact elements and in a second rotary position the circuit board plugged into the intake does not contact the at least one contact elements, such that the two housing parts are biased in the first rotary position by a spring element. On being moved the circuit board is centered before contacting the at least one contact elements. The intake may be spring-mounted.

The device may include a centering pin onto which an opening in the circuit board is pushed, and may further include at least two centering pins which differ in their form, dimensioning, or both. The centering pin or pins prevent the circuit board from being plugged into the intake in the first rotary position.

The device may include at least one interfering member which prevents the circuit board from being plugged into the intake in the first rotary position.

The at least one contact element may be used for the transmission of high frequency signals or the at least one contact element may be used for the transmission of direct current, or if the at least one contact element includes two or more contact elements, one such contact element may be used for the transmission of high frequency signals and another contact element may be used for the transmission of direct current. The contact element for the transmission of high frequency signals may include a central contact part which is arranged in coplanar alignment between two outer contact parts. The central contact part may be electrically connected with an inner conductor and the outer contact parts are electrically connected with an outer conductor of a coaxial cable leading away from the device.

The contact element for the transmission of direct current may be electrically connected with a ribbon conductor leading away from the device.

In a second aspect, the present invention is directed to a system which includes a circuit board and a device for contacting the circuit board, the device including: at least one contact element; an intake into which at least one section of the circuit board can be inserted; a housing comprising a first housing part forming the intake and a second housing part containing the at least one of contact element, whereby the two housing parts can be moved relative to one another; an actuator for moving the intake together with the circuit board relative to the at least one contact element until the at least one contact are contacted; and at least one securing component for fixing the circuit board in the position in which the at least one contact element are contacted; whereby the two housing parts can rotate relative to one another, whereby in a first rotary position the circuit board is plugged into the intake contacts the at least one contact elements and in a second rotary position the circuit board plugged into the intake does not contact the at least one contact elements, such that the two housing parts are biased in the first rotary position by a spring element.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
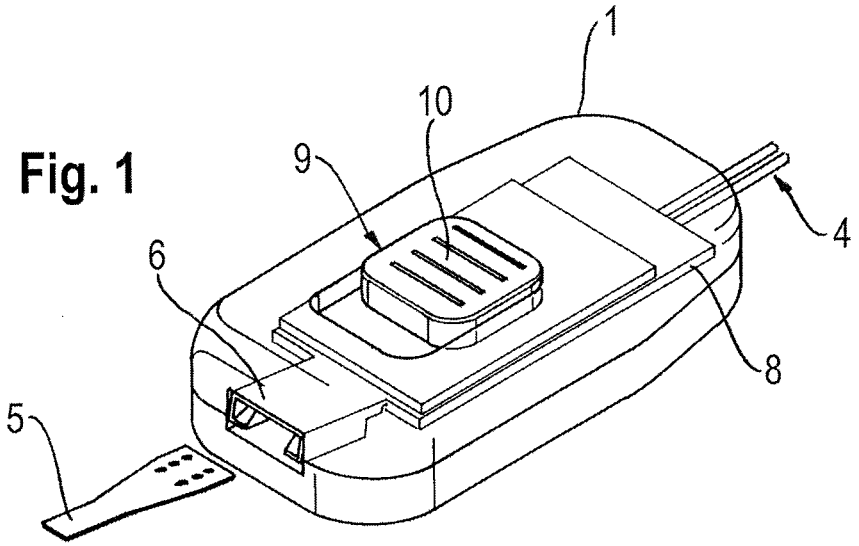
FIG. 1 to FIG. 3 show different steps in the use of a first embodiment of a device for contacting a circuit board in accordance with the invention.
Figure 2:
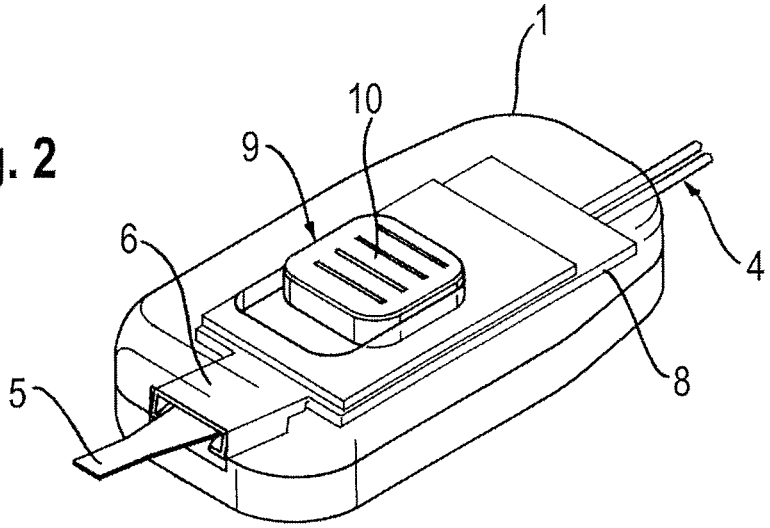

In describing the preferred embodiment of the present invention, reference will be made herein to FIGS. 1-13 of the drawings in which like numerals refer to like features of the invention.

The invention is based on the idea of contacting a circuit board with matching contacts quickly, securely and in particular with the application of low contact forces, in that the circuit board or the corresponding section of the circuit board which is to be contacted is fixed in an intake and a contacting of the circuit board and contact elements is then effected through a guided movement or sliding of the circuit board or of the relevant section, preferably fixed in the intake.

Accordingly, a device according to the invention for contacting a circuit board comprises at least the following elements:

one or more contact elements, which are preferably positioned immovably in the device and are in particular arranged within a (part of a) housing of the device;

(at least) one intake, into which at least one section of the circuit board can be inserted; the intake preferably embraces the circuit board or the section of the circuit board over as wide an area as possible and in particular only leaves exposed the section of the circuit boards on which those (sections of the) circuit paths are arranged which are to be contacted;

an actuator for moving or sliding the circuit board relative to the contact elements until a contacting with the contact elements takes place; the guided movement of the circuit board ensures that this moves towards the contact elements in a defined manner, which rules out contacting errors and moreover prevents the circuit board from tilting relative to the contact elements, as could occur where higher contact forces are used; and at least one securing component for fixing or retaining the circuit board in the position in which the contact elements are contacted, ensuring permanent contacting.

In a preferred embodiment of the device according to the invention, the device also possesses (at least) one centering element through which the circuit board is centered prior to the contacting of the contact elements. This is preferably achieved through the guided movement or sliding of the circuit board relative to the contact elements.

For example, (at least) one centering pin (preferably tapering in at least one section) can be provided onto which an opening in the circuit board is pushed, causing it to be centered. In this way it can be ensured that the circuit paths of the circuit board are aligned exactly in relation to the corresponding contact elements.

Particularly preferably, at least two centering pins can be provided which differ in terms of their form, arrangement and/or dimensioning and can engage in correspondingly arranged and/or dimensioned openings in the circuit board. This can create a coding which allows an incorrect insertion of the circuit board to be prevented.

Preferably, the circuit board can be moved or slid together with the intake in order to contact the contact elements. This makes it possible to apply the forces necessary for the movement to the intake and not to the circuit board. The transmission of these forces from the intake to the circuit board can then take place over a relatively large surface area and consequently with less pressure.

Also preferably, the intake can be spring-mounted. This means, on the one hand, that in its unloaded state, i.e. when it is not subjected by an actuator for sliding to a force causing movement, the intake is biased by the spring-loaded mounting into an initial position in which the circuit board does not contact the contact elements. This makes it possible to ensure that, on being plugged into the intake, the circuit board does not yet establish a contact with the contact elements. The sliding of the circuit board including the intake with the aim of contacting the contact elements can then take place against the opposing force of the spring-loaded mounting of the intake. The resulting pre-tensioning of the spring can, in addition, be used to fix the circuit board in the position in which the contact elements are contacted (contact position).

The sliding of the circuit board can preferably be effected by means of a slider, whereby the directions of the movement of the slider and the movement of the circuit board are preferably non-parallel (also non-coaxial). This non-parallelism of the movements of slider and circuit board has the advantage that a relatively large transmission ratio can be realized by simple means, so that a significantly greater sliding movement of the slider is necessary in order to effect the preferably relatively short movement of the circuit board from the initial position into the contact position. This facilitates the handling of the preferably manually operated slider.

The non-parallel movements of slider and circuit board can be achieved in a simple manner in that a contact surface of the slider slides on a contact surface of the circuit board and/or the intake, whereby, with respect to the direction of the relative movement, the contact surfaces are aligned at an angle of between $>0°$ and $<90°$ relative to one another. This means that the desired non-parallel movements of slider and circuit board can be realized in a simple manner, corresponding to the function of an "inclined plane". In addition, the transmission ratio of the two movements can be adjusted simply through the selection of the angle formed between the contact surfaces.

Furthermore, a force-locking fixing of the slider in the position in which the circuit board contacts the contact elements can be realized through this embodiment. This can be achieved in that the travel of the circuit board, as a result of the movement of the slider, takes place against the resilient force of a spring element. This resilient force can increase the friction between the two contact surfaces and consequently make possible a force-locking fixing of the slider in the contact position of the device. The elastic resilient forces can for example be applied by the spring-loaded mounting of the intake if the intake is displaced together with the circuit board. Alternatively or in addition, the advantageous possibility also exists of having the resilient forces applied by the contact elements, for example in that these are spring-mounted or generate the resilient forces themselves as a result of deformation.

In a preferred embodiment of the device according to the invention, this can possess a housing comprising a first housing part forming the intake and a second housing part containing the contact elements, whereby the two housing parts can be moved relative to one another.

The two housing parts can particularly preferably be designed so as to rotate relative to one another and can in particular be connected with one another in such a manner, whereby in a first rotary position a circuit board plugged into the intake contacts, or would contact, the contact elements and in a second rotary position a circuit board plugged into the intake does not contact or would not contact the contact elements.

Also preferably, the two housing parts are biased in the first rotary position by means of a spring element. In order to plug in the circuit board, the two housing parts are then rotated relative to one another into the second rotary position (for example manually), so that the circuit board can be plugged in without contacting the contact elements. A release of the two housing parts can then lead to the two housing parts being automatically moved into the first rotary position as a result of the spring force and fixed in this position through the spring force.

Since plugging the circuit board into the intake in the first rotary position could damage the contact elements and/or the circuit board, at least one interfering member can also preferably be provided which prevent the circuit board from being plugged into the intake in the first rotary position. These interfering members can preferably include the centering pin or pins which, in the first rotary position, are arranged in an insertion slot of the intake and consequently prevent the circuit board from being plugged into the intake.

In a further preferred embodiment of the device according to the invention, at least one HF contact element can be provided for the transmission of high frequency signals and at least one DC contact element can be provided for the transmission of direct current. The HF contact element can thereby advantageously comprise a central contact part which is arranged in a coplanar alignment between two outer contact parts.

Since coaxial cables are advantageously suitable for the transmission of high frequency signals, the central contact part can also preferably be electrically connected with an inner conductor and the outer contact parts can be electrically connected with an outer conductor of a coaxial cable leading away from the device. The device or the HF contact elements can, for example, be connected with a measuring device by the coaxial cable.

In contrast, the DC contact element can, advantageously, be electrically connected with a preferably flexible ribbon conductor leading away from the device. These can be distinguished through low costs and a low space requirement. A direct contacting to one or more stranded copper conductors is also possible.

The contacting of the circuit board with the contact elements of the device according to the invention is, in particular, intended to allow high frequency signals (HF signals) to be transmitted.

The device represented in FIGS. 1 to 5 possesses a housing 1. Within the housing 1, a carrier plate 2 is arranged, on the surface of which several electrical contact elements 3 are arranged. Each of these contact elements 3 is connected with a signal cable 4, these being passed out from the housing through an opening in one side of the housing 1. The signal cables 4 can for example lead to a measuring device (not shown) by means of which a function test of a circuit board 5 is to be carried out. In order to carry out the function test, the circuit board 5 is contacted in a defined manner with the contact elements 3, so that each of the contact elements 3 contacts a predetermined position on one of the circuit paths of the circuit board 5.

In order to achieve the contacting with the contact elements 3, one end of the circuit board 5 is inserted into an intake 6 which is formed by an intake element 7 arranged within the housing 1. The intake element 7, preferably made of plastic, comprises two parts (see in particular FIG. 5), the intake 6 and a fixing plate 8 resiliently connected with this which is fixed immovably within the housing 1. The intake 6 is so designed that this at least partially embraces the inserted section of the circuit board 5 on five sides (inserted end face, upper side, both side surfaces and underside) and in particular only leaves exposed a section on its underside on which the circuit paths which are to be contacted are located. The circuit board 5 is thereby inserted so far into the intake slot formed by the intake 6 that its end face comes to rest against the base of the intake slot.

The device also includes an actuating element in the form of a slider 9. The slider 9 forms an elevation 10 which is guided in a corresponding slot of the housing 1. By means of the elevation 10, the slider 9 can be moved manually in the directions defined through the slot of the housing 1. Parallel grooves in the surface of the elevation 10 thereby ensure adequate resistance to slipping when, for example, the slider is operated with the thumb of a hand.

When the slider 9 is moved, it slides on the upper side of the intake plate 7. Through a movement of the slider 9 starting out from the initial position shown in FIGS. 1, 2 and 4, in which the underside of the slider 9 is exclusively in contact with the upper side of the fixing plate 8 of the intake element 7, the front end of the slider 9 slides over the upper side of the intake 6. As a result, the intake 6, the upper side of which, in the unloaded initial position, is not coplanar with the upper side of the fixing plate 8 but rises gently in the direction of movement of the slider 9, swivels downwards. This movement is opposed by a resilient force resulting from a deformation of the spring-loaded connection of the intake 6 to the fixing plate 8. Through the swiveling of the intake 6, this, together with the inserted sections of the circuit board 5, is moved towards the contact elements 3.

During the course of this movement, the circuit board 5 is first positioned exactly in relation to the contact elements 3 in that several tapered positioning pins (not shown) engage in corresponding positioning openings in the circuit board 5 (see FIG. 1). Only following engagement of the positioning pins in the positioning openings and the resulting positioning of the circuit board 5, i.e. following a further swiveling of the intake 6 and of the sections of the circuit board 5 accommodated therein, does a contacting of the circuit paths arranged on the underside of the circuit board 5 with the contact elements 3 take place. This ensures that the contacting takes place exactly on the intended positions on the circuit paths.

Figure 3:
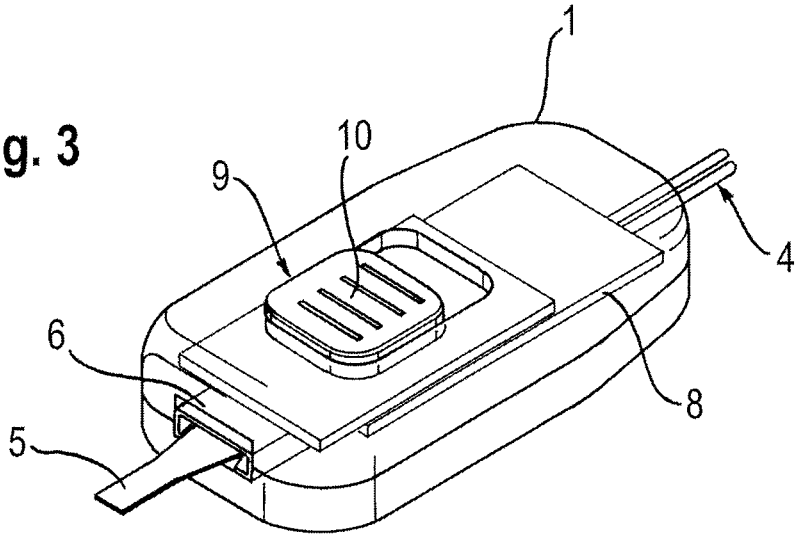
Figure 4:
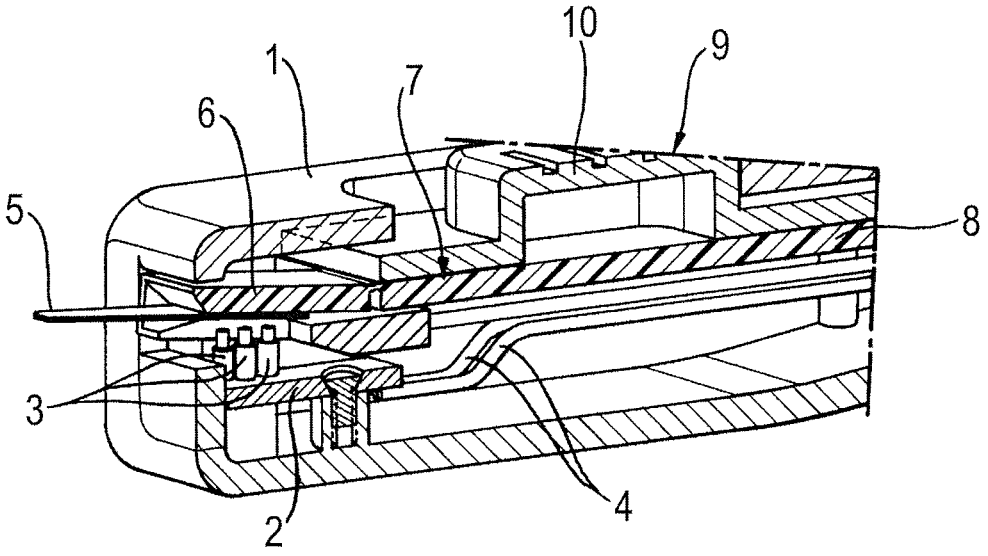
FIG. 4 shows a section of the device according to FIGS. 1 to 3 in an isometric longitudinal section.
Figure 5:
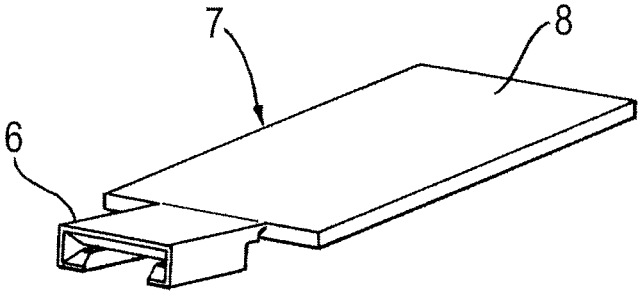
FIG. 5 shows an isometric view of an intake element of the device according to FIGS. 1 to 4.

In the position of the slider 9 shown in FIG. 3, i.e. when this has been pushed far as possible in the direction of the free end of the intake 5, the circuit board 5 contacts the contact elements 3 arranged beneath it. In this contact position of the device, the slider 9 is fixed in a force-locking manner (self-locking), so that the contacting must be disconnected actively by pushing back the slider 9 manually.

The force-locking fixing of the slider 9 is effected through the friction which occurs between the contact surfaces of the slider 9 and the associated contact surfaces of the housing 1 or of the intake element 7. This friction can readily be selected as being so great that the desired force-locking fixing is achieved, since due to the spring-loading of the intake 6 the slider 9 is clamped between this and the housing 1. This spring loading results not only from the deformation of the connection of the intake 6 to the fixing plate 8, but additionally from resilient forces which the contact elements 3 transmit to the circuit board 5 which in turn transmits these to the intake 6. For this purpose, the contact elements 3 can be spring mounted or designed in the form of spring contact pins in which at least two parts can be displaced relative to one another against the tension of an (in particular telescopic) spring element.

Insofar as HF signals are to be transmitted by means of the contacting of the circuit board 5 and contact elements 3, the contact elements 3 can, for example, be designed as conventional co-planar LIGA contacts. If, on the other hand, direct current is to be transmitted, the contacts can, in particular, be conventional spring contact pins. Naturally, a combination of different contact elements (e.g., LIGA contacts and spring contact pins) can also be used.

The embodiment of a device according to the intervention shown in FIGS. 6 to 13 possesses a two-part housing. A base body 11 (second housing part) of the housing is part of a lower section of the device. A cover 12 (first housing part) of the housing is part of an upper section of the device. The base body 11 and cover 12 are connected together rotatably in the manner of a rocker switch by two cylindrical aligning pins 13.

The base body 11 of the housing forms a seating recess in which two (electrically conductive) HF contact elements 14 are arranged. The HF contact elements 14 are designed as coplanar metallic contact elements and each comprise a central contact part 15 as well as two outer contact parts 16 arranged laterally in coplanar alignment alongside the central contact part 15. The central 15 and outer contact parts 16, which can, for example have been manufactured by means of a so-called LIGA method, form between them electrically insulating air gaps. Their position relative to one another is in each case secured through two insulators 17 which are fixed (e.g. adhesively) to the HF contact elements 14 in the vicinity of the cable-side end. The HF contact elements 14 are in each case connected (e.g., adhesively) with the base body 11 of the housing by one of the insulators 17.

The section of an HF contact element 14 which is located between its contact-side end and the associated insulators 17 projects freely into space. This allows the contact points of the HF contact elements 14 formed on the contact-side end to deflect resiliently on contact with associated contact points of a circuit board 18 which is being tested (see FIG. 8). This ensures a defined contact pressure and a tolerance compensation.

The HF contact elements 14 are each connected on their cable-side ends with a coaxial cable 19. For this purpose, an inner conductor 20 of each coaxial cable 19 tapering at its end contacts the central contact part 15 of the associated HF contact elements 14, while the two outer contact parts 16 of each of the HF contact elements 14 are connected (via the electrically conductive base body 11) in an electrically conductive manner with an outer conductor 39 of the associated coaxial cable 19.

High frequency signals are to be transmitted between the circuit board 18 and a measuring device (not shown) via the HF contact elements 14 and the coaxial cable 19. In order to provide a good shielding of the high frequency signals, the base body 11 of the housing is designed to be electrically conductive, for example being made of metal or also a metallized (e.g. a metallically coated) plastic. The design of the HF contact elements 14 as coplanar contact elements as well as the transmission by the coaxial cable 19 contributes to a good shielding of the high frequency signals.

The base body 11 also possesses two positioning posts 21 which engage in associated positioning openings 22 of the circuit board 18 in order to position this exactly in the device as well as to fix it therein. Different diameters of the two pairs of positioning posts/positioning openings ensure that the circuit board 18 is fitted into the device in the correct orientation.

Figure 11:
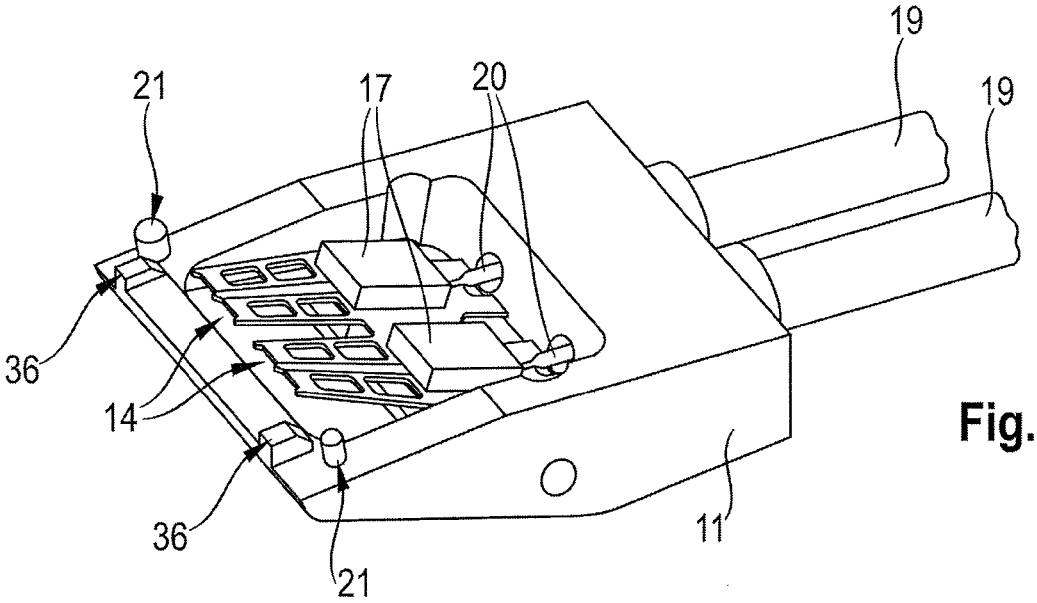
FIG. 11 shows a perspective view of a lower section of the device according to FIGS. 6 and 7.
Figure 12:
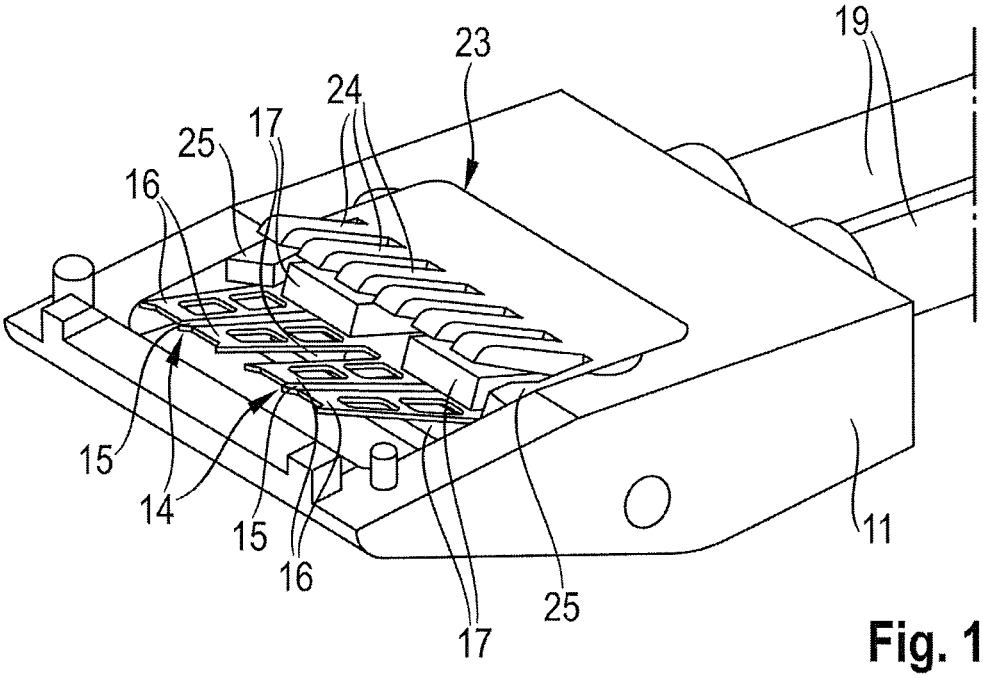
FIG. 12 shows the lower section according to FIG. 10 with integrated spring contact comb.
Figure 13:
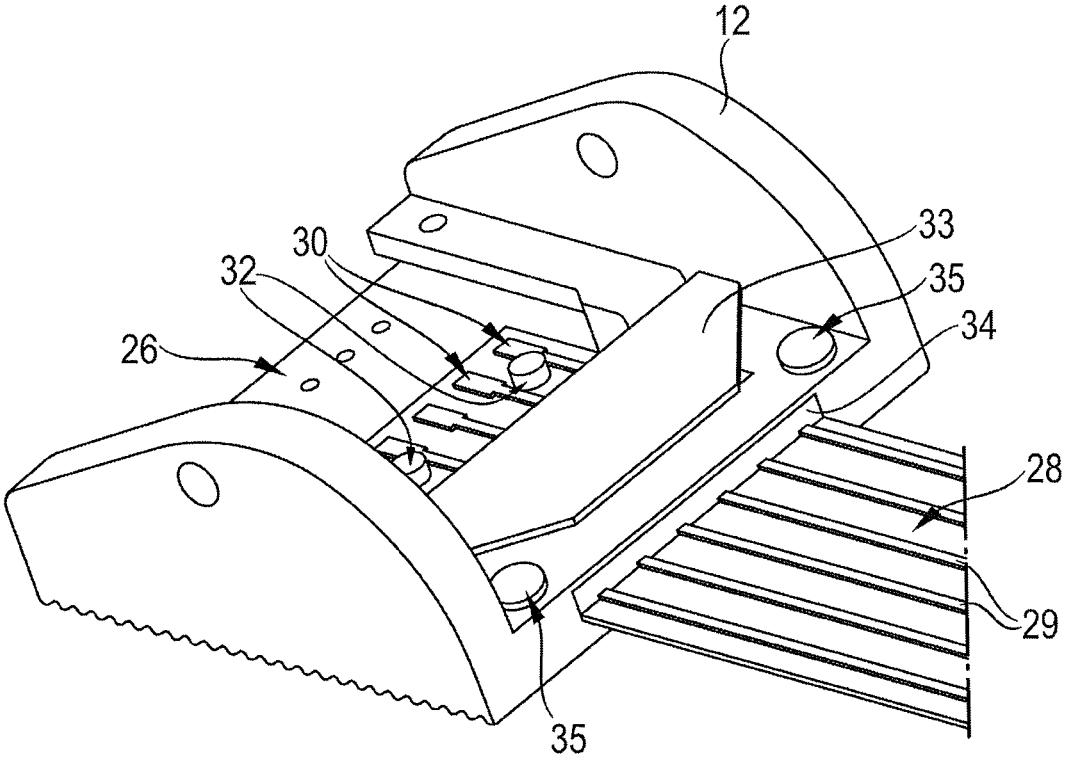
FIG. 13 shows a perspective view of an upper section of the device according to FIGS. 6 and 7.

The lower section of the device also includes a spring element in the form of a spring comb 23 (see FIGS. 11 and 12). This has a base body which is fixed to the base body 11 of the housing via the spring comb 23. A plurality of spring fingers 24 extends from the base body. The spring comb 23 is intended to ensure a secure contacting of the circuit board 18 with the contact regions (DC contact elements) formed by the upper section of the device. Two lateral supporting arms 25 thereby prevent the spring comb 23 from tilting up when a load is applied to the spring fingers 24. Advantageously, the spring comb 23 can be made of plastic.

The cover 12 of the housing forms an intake 26 for the circuit board 18. Two lateral guide slots 27 thereby guide the insertion and withdrawal movements of the circuit board 18. One end of a ribbon conductor 28 projects into the intake 26. Several circuit paths 29 are arranged on the side of the ribbon conductor 28 facing the lower section or the inserted circuit board 18 which form end contact regions (DC contact elements 30). These are intended to contact associated contact regions of circuit paths 31 on the circuit board 18. When the device is in operation, only direct currents are intended to be transmitted via the circuit paths 29, 31, so that no expenditure on shielding is necessary. The cover 12 of the housing can therefore also advantageously be made of plastic (e.g. thermoplastic). For its positioning and fixing, the ribbon conductor 28 has positioning openings into which the positioning posts 32 of the cover 12 project. In addition, the ribbon conductor 28 is fixed to the cover 12 in that it is clamped between the cover 12 and a spring element 33, with an intervening elastomer element 34. The connection of these elements with the cover 12 can for example be effected by, for example, rivet pins 35 formed by the cover 12 which extend through fixing openings of the spring element 33. The free ends of the rivet pins 35 can then be deformed thermally or through the application of pressure such that their diameter is enlarged in the end region. This creates a form-locking connection with the spring element 33. Preferably, the deformation of the rivet pins 35 takes place with simultaneous application of pressure to the spring element 33 and a resulting compression of the elastomer element 34 which, following deformation of the rivet pins 35, remains at least partially erect. This leads to a largely play-free fixing of the ribbon conductor 28 to the cover 12.

Figure 6:
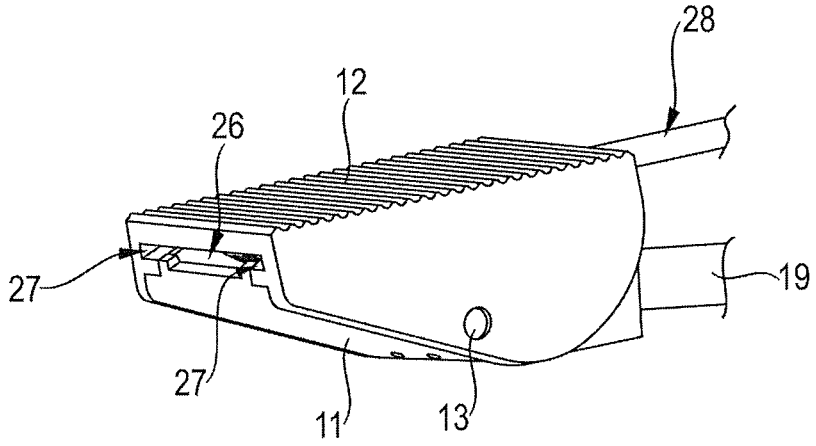
FIG. 6 shows a perspective view of a second embodiment of a device in accordance with the invention (without circuit board) in its closed state.

When the device is fitted, the spring element 33, formed as a leg spring, biases the housing or the device in its closed position (first rotary position), as shown for example in FIG. 6. In this position, the circuit board 18 cannot be inserted into the intake 26, since the positioning posts 21 project into the intake 26.

Figure 7:
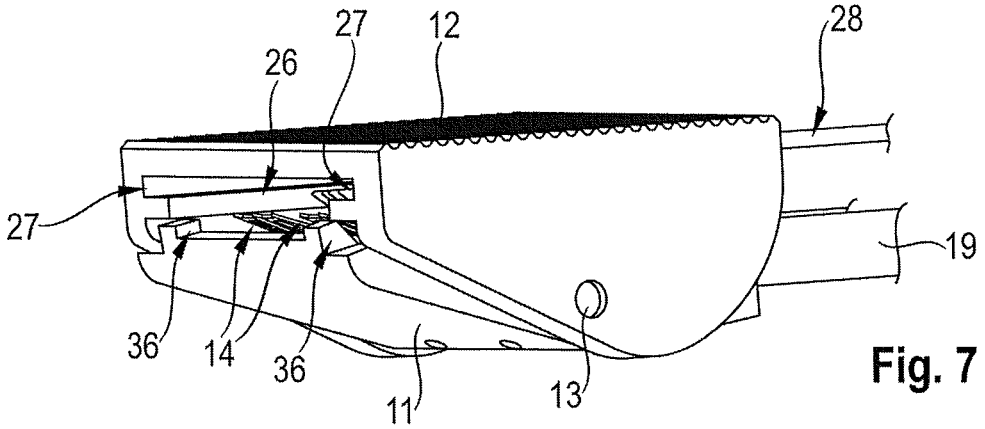
FIG. 7 shows the device according to FIG. 6 in its closed state.
Figure 8:
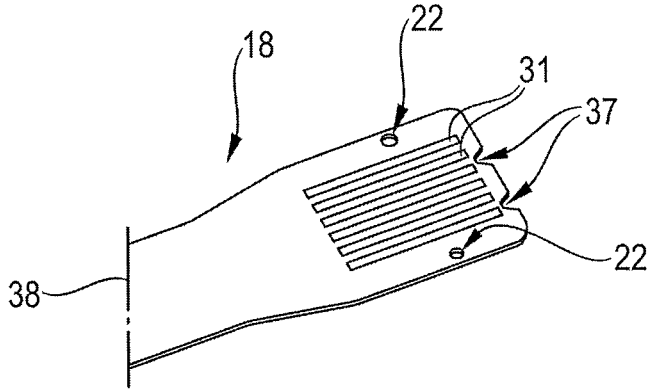
FIG. 8 shows a perspective view of a circuit board for use with the device according to FIGS. 6 and 7.
Figure 9:
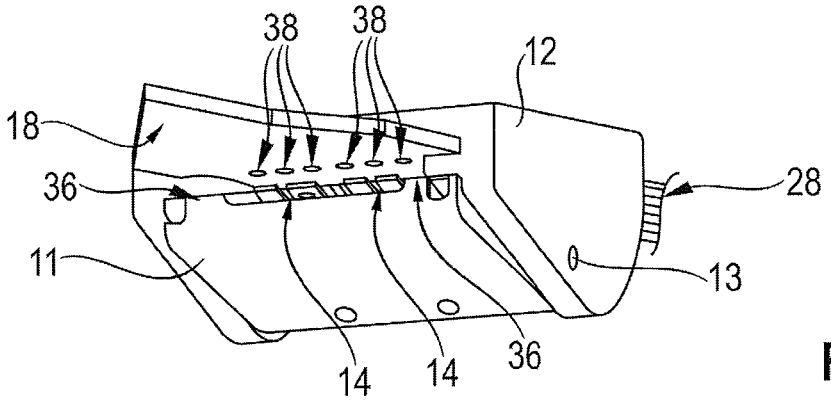
FIG. 9 shows a perspective view of the device according to FIGS. 6 and 7 with partially inserted circuit board according to FIG. 8.
Figure 10:
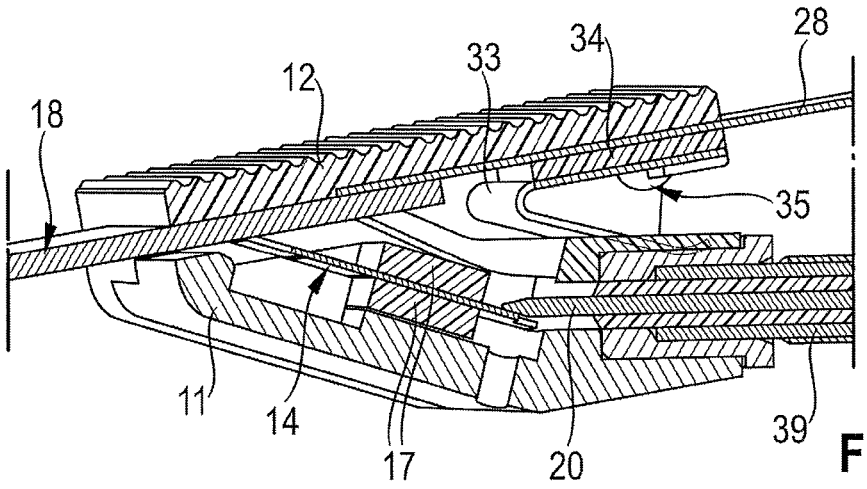
FIG. 10 shows a perspective view of a longitudinal section through the device according to FIG. 9 with completely plugged-in circuit board.

Insertion of the circuit board 18 into the intake 26 is only possible in the opened position of the device (second rotary position) shown in FIG. 7. In order to open the device, it must be pressed together manually at the end from which the coaxial cable 19 as well as the ribbon conductor 28 emerge. This causes the base body 11 and the cover 12 of the housing to spread apart slightly, such that the positioning posts 21 open up the intake 26. The circuit board 18 can then be inserted into the intake 26 until it meets an axial stop, whereby two acutely converging notches 37 in the front edge of the circuit board 18 interact with the positioning posts 32 of the cover 12 in order to ensure the correct angular alignment of the circuit board 18. Like the positioning posts 21, the asymmetrical arrangement of the notches 37 in relation to the longitudinal axis of the circuit board 18 prevents the circuit board 18 from being (completely) inserted into the intake 26 the wrong side up.

Following complete insertion of the circuit board 18, the pressure on the housing can be released. The spring element 33 then moves the two parts of the housing back into their closed position and holds (fixes) the housing in this position. The positioning posts 21 of the lower section thereby engage in the positioning openings 22 in the circuit board 18. This causes the circuit board 18 to be exactly positioned and fixed in the device. At the same time, the HF contact elements 14 contact corresponding HF contact points 38 on the underside of the circuit board 18, whereby the HF contact elements 14 are slightly elastically deformed in order to create sufficient contact pressure and tolerance compensation. Two stop pins 36 thereby rest against the circuit board 18 and thus limit the elastic deformation of the HF contact elements 14, preventing them from being damaged. For this purpose, the HF contact elements 14 project beyond the stop pins 36 by a defined measure. The DC contact elements 30 of the ribbon conductor 28 also contact the associated circuit paths 31 on the upper side of the circuit board 18 (DC contact pairs). The spring fingers 24 of the spring comb 23, deformed elastically through the closure of the device, thereby ensure sufficient contact pressure and tolerance compensation. In this exemplary embodiment, one spring finger 24 is provided for each DC contact pair. This makes it possible to ensure that the necessary contact pressure is applied to each DC contact pair, also where the circuit board 18 has a flexible carrier plate 38, and that individual tolerance compensation is achieved for each of these.

A corresponding functionality can also be achieved through the use, as a substitute for the spring comb 23, of a spring element (not shown) which possesses a common spring base body (e.g. in the form of a leg spring), whereby individual contact tabs made of an elastic material are attached to the edge facing the circuit board 18 (designed as a continuous pressure-contact edge). In this case the spring base body can substantially ensure the contact pressure while the contact tabs ensure individual tolerance compensation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A device for contacting a circuit board comprising:

at least one contact element;

an intake into which at least one section of the circuit board can be inserted;

a housing comprising a first housing part forming the intake and a second housing part containing said at least one of contact element, whereby the two housing parts can be moved relative to one another;

an actuator for moving the intake together with the circuit board relative to the at least one contact element until the at least one contact are contacted; and at least one securing component for fixing the circuit board in the position in which the at least one contact element are contacted;

whereby the two housing parts can rotate relative to one another, whereby in a first rotary position said circuit board is plugged into the intake contacts the at least one contact elements and in a second rotary position the circuit board plugged into the intake does not contact the at least one contact elements, such that the two housing parts are biased in the first rotary position by a spring element.

2. The device of claim 1, wherein on being moved the circuit board is centered before contacting the at least one contact elements.

3. The device of claim 2, including a centering pin onto which an opening in the circuit board is pushed.

4. The device of claim 3, including at least two centering pins which differ in their form, dimensioning, or both.

5. The device of claim 1 wherein the intake is spring-mounted.

6. The device of claim 1 including at least one interfering member which prevents the circuit board from being plugged into the intake in the first rotary position.

7. The device of claim 3 wherein the centering pin or pins prevent the circuit board from being plugged into the intake in the first rotary position.

8. The device of claim 1 wherein said at least one contact element is for the transmission of high frequency signals or said at least one contact element is for the transmission of direct current, or if said at least one contact element includes two or more contact elements, one such contact element is for the transmission of high frequency signals and another contact element is for the transmission of direct current.

9. The device of claim 8 wherein the contact element for the transmission of high frequency signals comprises a central contact part which is arranged in coplanar alignment between two outer contact parts.

10. The device of claim 9, wherein the central contact part is electrically connected with an inner conductor and the outer contact parts are electrically connected with an outer conductor of a coaxial cable leading away from the device.

11. The device of claim 8, wherein the contact element for the transmission of direct current is electrically connected with a ribbon conductor leading away from the device.

12. A system which includes a device according to claim 1 and a circuit board.

13. The device of claim 3 wherein the intake is spring-mounted.

14. The device of claim 4 wherein the centering pin or pins prevent the circuit board from being plugged into the intake in the first rotary position.

15. The device of claim 6 wherein the centering pin or pins prevent the circuit board from being plugged into the intake in the first rotary position.

16. The device of claim 4 wherein said at least one contact element is for the transmission of high frequency signals or said at least one contact element is for the transmission of direct current, or if said at least one contact element includes two or more contact elements, one such contact element is for the transmission of high frequency signals and another contact element is for the transmission of direct current.

17. The device of claim 7 wherein said at least one contact element is for the transmission of high frequency signals or said at least one contact element is for the transmission of direct current, or if said at least one contact element includes two or more contact elements, one such contact element is for the transmission of high frequency signals and another contact element is for the transmission of direct current.

18. The device of claim 16 wherein the contact element for the transmission of high frequency signals comprises a central contact part which is arranged in coplanar alignment between two outer contact parts.

19. The device of claim 18, wherein the central contact part is electrically connected with an inner conductor and the outer contact parts are electrically connected with an outer conductor of a coaxial cable leading away from the device.

20. The device of claim 10, wherein the contact element for the transmission of direct current is electrically connected with a ribbon conductor leading away from the device.

* * * * *